United States Patent [19]

Karlberger

[11] 4,024,745

[45] May 24, 1977

[54] ROD COOLING AND COILING SYSTEM

[75] Inventor: Walter Johann Karlberger, Smedjebacken, Sweden

[73] Assignee: Morgardshammar Aktiebolag, Smedjebacken, Sweden

[22] Filed: Jan. 27, 1975

[21] Appl. No.: 544,180

[52] U.S. Cl. ..... 72/201; 140/2; 148/156; 266/112

[51] Int. Cl.² ..... B21B 45/02; B21F 21/00; C21D 1/62

[58] Field of Search ..... 72/66, 201; 140/2; 266/2 R, 3 R, 4 A, 4 B, 6 R, 6 D, 112; 148/153, 156; 242/79, 81

[56] References Cited

UNITED STATES PATENTS

| | | | |
|---|---|---|---|
| 627,723 | 6/1899 | Edwards | 266/2 R |
| 698,121 | 4/1902 | Liebert | 266/6 D |
| 854,810 | 5/1907 | Daniels | 148/156 |
| 2,516,248 | 7/1950 | O'Brien | 148/156 X |
| 3,442,029 | 5/1969 | Adair | 148/156 X |
| 3,813,087 | 5/1974 | Boehm et al. | 148/153 X |
| 3,850,204 | 11/1974 | Hauck | 140/2 |
| 3,926,382 | 12/1975 | Sieurin et al. | 242/79 |

FOREIGN PATENTS OR APPLICATIONS

| | | | |
|---|---|---|---|
| 395,960 | 7/1933 | United Kingdom | 266/6 R |
| 438,421 | 11/1935 | United Kingdom | 266/6 R |

*Primary Examiner*—E. M. Combs

[57] ABSTRACT

An improved rod coiling and cooling system includes a coiler which receives hot rod from a rod rolling stand. A guide or repeater section is provided between the rolling stand to effect a bending of the rod to guide it into the coiler. The coiled rod is transferred from the coiler to one of a plurality of coil supports disposed in an indexable tank of water. When a length of rod has been coiled and deposited on one of the coil supports the tank is indexed to move a next adjacent coil support into position to receive a succeeding coiled rod from the coiler. After a coiled rod has cooled in the tank of water, it is transferred to a car, is moved along a first set of rails to a first turntable which is rotated to position the loaded car on a second set of rails leading to a bundling station and a station where the cooled coil is removed from the car. The empty car is moved onto a second turntable which positions the car for movement along the first set of rails back to the loading station.

15 Claims, 5 Drawing Figures

ROD COOLING AND COILING SYSTEM

BACKGROUND OF THE PRESENT INVENTION

Hot rolling of steel wire rod requires high rolling speeds in order to obtain the large tonnages required today at economical production rates. In addition to the demand for high speed, users demand larger nd larger coil weights in order to save handling costs in the later handling of the wire rod for wire drawing, cold heading, etc.

Steel wire rod of medium to high carbon content requires heat treatment before it can be drawn into wire. It has become more and more common to perform this heat-treating in line with the rolling, utilizing the heat in the rod as it exits from the last finishing stand for heat-treating purposes. Several such in-line patenting processes are known, most of them utilize forced air-cooling of the wire after forming the wire into loops, which later are collected into coils. In order to make the air-cooling effective, the loops must be spread out sidewise on a conveyor belt, or kept as round separated loops. The best known of these in-line patenting processes is so-called "Stelmor" process which is described, for instance, in U.S. Pat. No. 3,231,432. In this process, the coil is spread on a moving conveyor, and later after cooling collected into coils. This process allows for the high rolling speeds, and also makes large coil sizes possible, which only are limited by the size of the collecting mechanism, as well as by the billet size. This process suffers from the disadvantage or difficulty of obtaining absolutely even cooling of all parts of the coils, for instance, the parts of the coils which overlap on the moving conveyor are not subject to the same cooling as the remainder of the coil. Air cooling also causes problems because of varying ambient air temperature and humidity. Finally, the spread-out of the coils causes difficulties in forming good coils for future handling because of the spring effect of the spread-out coils forcing the coils into wrong shapes. This is especially pronounced in coils having a high carbon level, say from 0.50% and up.

Another process for in-line patenting of hot rolled wire rod is described in U.S. Pat. No. 3,669,762. In this process, termed the "ED" process, the hot coiled rod is put directly into a water tank where a vapor barrier forms around the wire rod and delays cooling in a critical transition period of the metal. This process is a batch process with two coilers per rolling stand with the rod from alternate billets being switched to alternate coilers. This switching causes serious problems at high rolling speeds, such as 10,000 f.p.m. or more, which is becoming common today.

This type of in-line patenting could also be modified so that the coils will spread out on a moving conveyor belt under water. Thereby, it would be possible to attain the ability to roll unlimited coil weights at high speeds. However, problems of forming good coils of high carbon steels would remain.

A further problem when rolling wire rod at high speeds is to change the direction of the rod emerging from the mill so that it is properly received by the coiler. The reason for this difficulty is that especially low carbon rod is very soft and will start buckling and cause trouble in the mill whenever an effort to change its direction is made.

It is preferable to direct the rod vertically downwardly into the coiler, whereas the rolling mill commonly produces the wire rod emerging in a horizontal plane. This necessitates a change in the direction of the rod. In order to achieve this change in direction of the wire rod without causing cobbles, the most successful method up to now has been to feed the wire into a conveyorlike structure having a curved shape with the conveyor running at exactly the same speed as the wire rod. This method, however, causes great difficulties in synchronizing the conveyor with the wire rod, and the conveyor also suffers from very rapid wear at high wire rod speeds.

SUMMARY OF THE PRESENT INVENTION

The present invention is directed to a rod coiling, cooling, and handling system which eliminates problems of the prior art and which is efficient in operation and practical in construction. In accordance with the present invention, the rod, as it exits from the rolling mill, is directed to a coiler which coils the rod into a bath, preferably a hot water bath. The hot water bath has a plurality of coil receiving stations and is indexible in order to locate each of the plurality of coil receiving stations of the bath beneath the coiler. Therefore, a single coiler can feed and coil the rod material into the bath while a previously coiled rod is being removed from the bath.

The coil, once it has been cooled in the water bath, is removed therefrom and placed on a conveyor or handling system which includes a plurality of cars which move along a track. The cars are moved along the track by a suitable conveyor mechanism to a bundling station where the coil is bundled.

The station at which coils are removed from the water bath and the bundling station and the station where coils are removed from a car are located in-line and in one preferred arrangement the cars move through all of these stations and in a continuous path so that the coils are further cooled as they move between the coil removing station and the bundling station. The movement of the cars in the continuous path and the changing of the direction of movement of the cars in the path is performed by a unique handling system.

Further in accordance with the present invention, as the rod exits from the rolling mill, its direction of movement is changed from the horizontal to the vertical so that the coiler receives the rod when it is in a vertical orientation. In order to effect this change in direction, a simplified and improved structure is provided between the rolling mill and the coiler. This mechanism includes guides and pinch rolls which engage the rod. A scanner is provided in order to sense the position of the rod between the guides and the scanner controls the speed of rotation of the pinch rolls in order to control the location of the rod between the guides so that minimum wear of the guides or marring of the rod occurs.

DESCRIPTION OF THE FIGURES

Further features of the present invention will be apparent to those skilled in the art to which it relates from the following detailed description of a system embodying the present invention and which description is made with reference to the drawings in which.

DESCRIPTION OF THE PREFERRED EMBODIMENT

As noted hereinabove, the present invention is directed to a rod cooling, coiling, and handling system and which system is of a practical construction and enables rod to be cooled, coiled, and handled in an efficient and effective manner.

Figure 1:
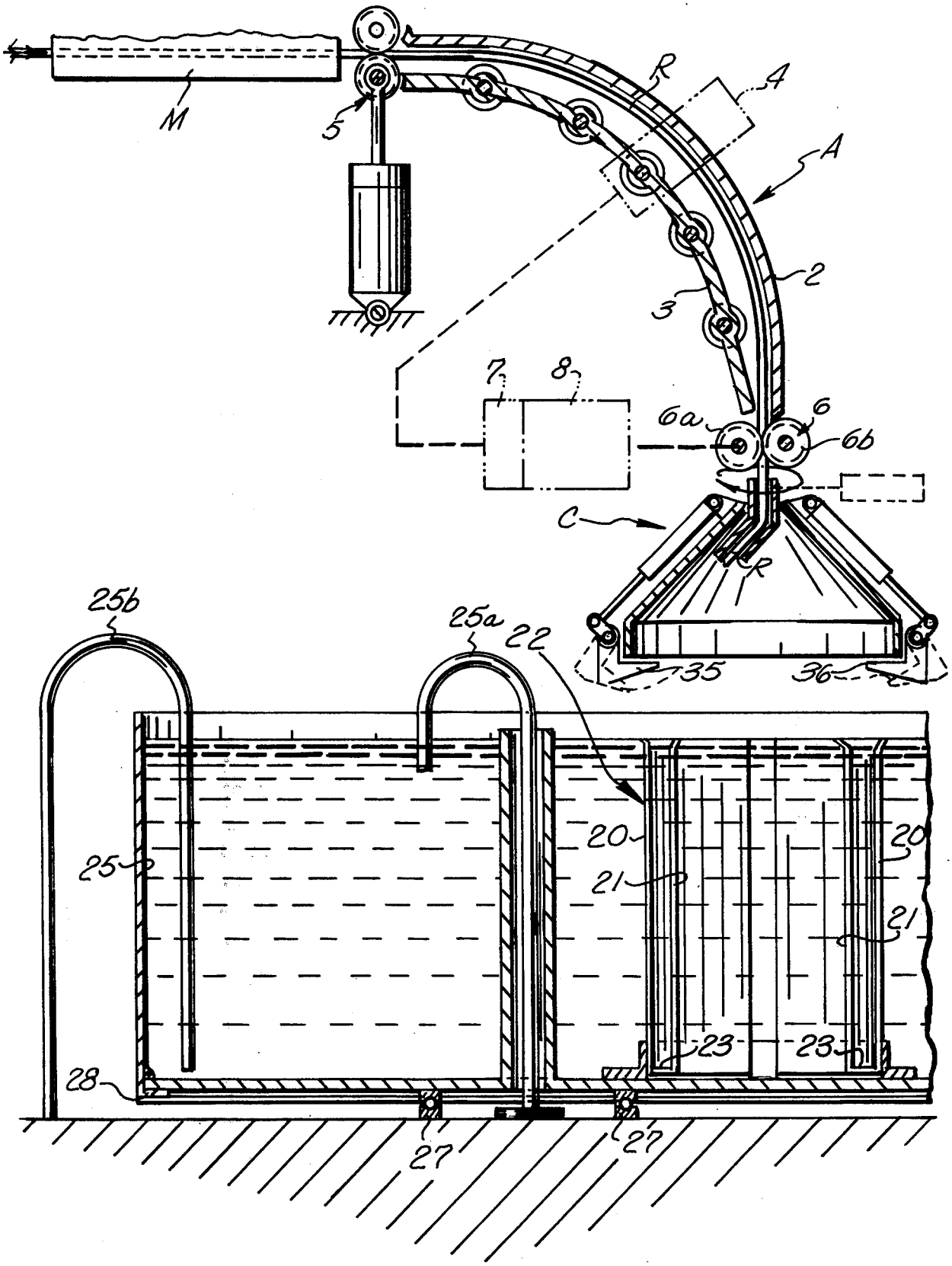
FIG. 1 is a somewhat schematic view illustrating the rod exiting from the rod mill and being coiled into a water bath.

The specific structural details of the system may vary and the specific system illustrated is merely representative. As best shown in FIG. 1, the present invention is directed to a system for handling wire rod which is rolled in a rolling mill M. The rod R exits from the mill M in a generally horizontal direction. It is conveyed or guided into a coiler mechanism C. As best shown in FIG. 1, the rod R enters the coiler mechanism C in a generally vertical direction, whereas it exits from the rolling mill M in a horizontal direction. Thus, the direction of movement of the rod is changed from the horizontal to the vertical.

The change in the direction of movement of the wire rod R is performed in a so-called repeater A which is common equipment in rod and bar mills for bending and guiding rods and bars horizontally between mill stands. In FIG. 1, the repeater A is shown as including an outer guide section 2 and an inner guide section 3 which limit the travel of the wire rod therebetween. In advance of the repeater A, that is between the repeater A and the rolling mill M, are located pinch rolls 5. At the exit end of the repeater A before the wire rod enters the coiler C is a second set of pinch rolls 6. A photoelectric scanner 4 is positioned between the pinch rolls 5 and 6 so as to sense the position of the wire rod between the outer and inner guides 2 and 3. The output signal from the photoelectric scanner 4 is transmitted to suitable speed controls 7 for a pinch roll drive motor 8. The photoelectric scanner 4 could vary the speed at which the mill operates while the speed of the pinch rolls remain constant and thereby maintain the desired position of the rod.

When the lead end of hot wire rod R emerges from the finishing stand of the rolling mill M, it first enters pinch rolls 5. The lead end of the rod then hits the outer guide section 2 and is deflected downwardly toward pinch rolls 6. The pinch rolls 6 guide the wire rod into the coiler C, which forms the rod into a coil in a well known manner.

Figure 3:
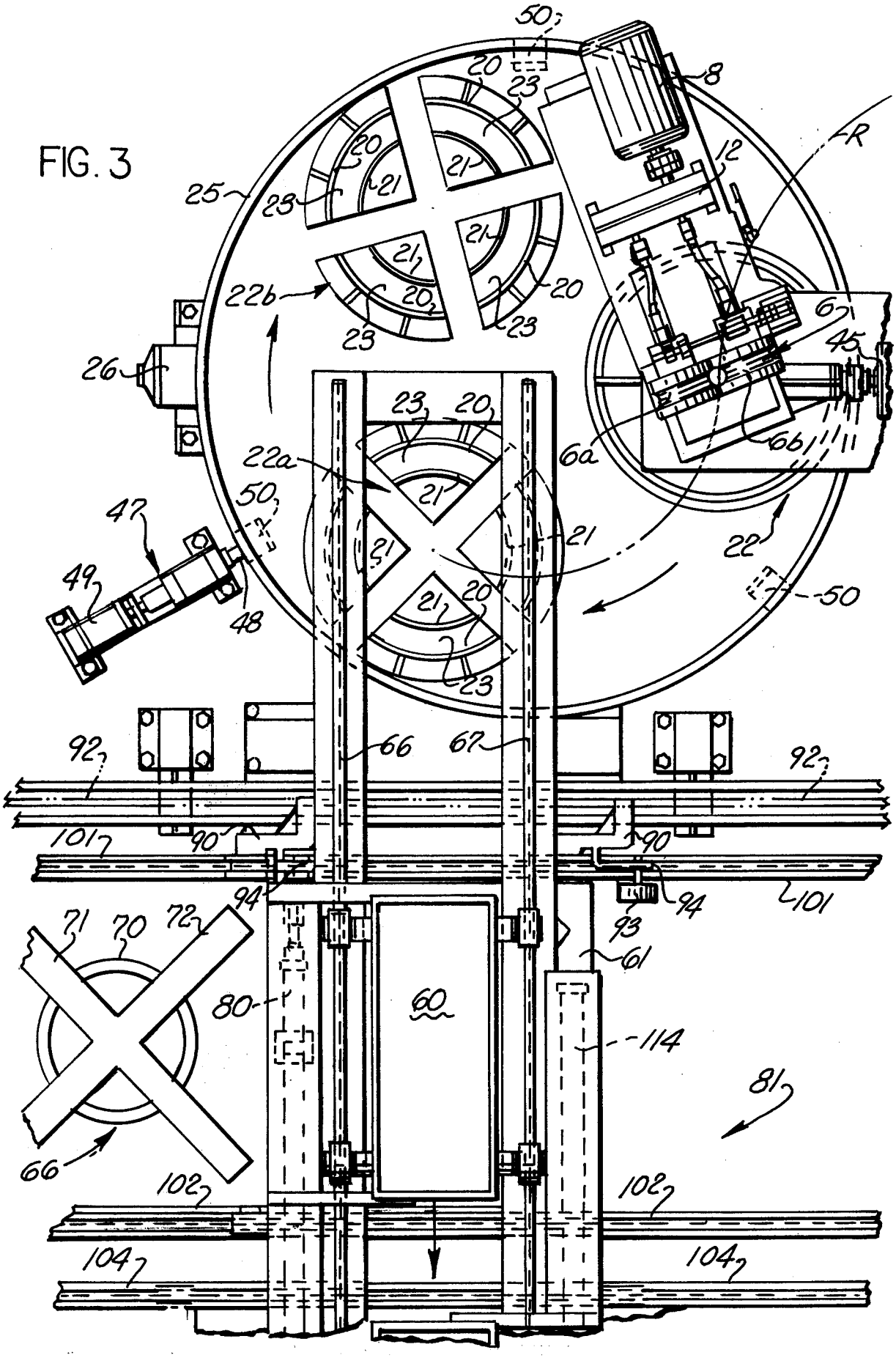
FIG. 3 is an enlarged plan view of a portion of the system shown in FIG. 2.

As soon as the wire rod R enters the coiler C, the pinch rolls 5 are opened so that they do not any longer touch the wire rod. This is accomplished by a signal from the sensor 4 which actuates a suitable solenoid valve with a slight delay to enable the rod to reach rolls 6 before the rolls 5 are opened. The second set of pinch rolls 6 are initially driven at a slightly higher speed than the rod R emerging from the finishing stand of the rolling mill. Thus, the position of the rod in the repeater will change and the photoelectric sensor 4 will sense the change and send a correction signal to its speed control device 7 for the pinch roll motor 8. The motor 8 is connected through a suitable device 12 to the two pinch rolls 6a and 6b (as shown in FIG. 3). When the rod reaches a position close to midway between the outer and inner guides 2, 3, the photocell scanner 4 will provide a signal such that the pinch roll speed controls 7 will maintain the speed at which the pinch rolls 6 keep the rod R position stable at the midpoint location, i.e., when the speed of the pinch rolls and finishing stands are correctly synchronized.

When the tail end of the rod leaves the finishing stand (last stand) of the rolling mill, it will be pulled through its path and through the repeater by pinch rolls 6. In order to avoid scratching or marking of the rod, the repeater can be provided with rolls at suitable points along its inner guide 3 circumference. The photoelectric scanner 4 used to control the position of the rod in the repeater is of a well-known design, and will not be described herein.

As noted above, the rod R, as it exits from the repeater section A, is directed into the coiler C. The coiler C may take a variety of different forms, but basically includes a coiler head which is rotated in synchronism with the pinch rolls to form the rod into a helical coil. The turns of the coil drop into guide slots formed between concentric guides 20 and 21 of a coil support 22. The guides 20, 21 direct the coils onto a coil support bottom wall 23.

As best shown in FIG. 3, there are three equally spaced coil supports 22, 22*a* and 22*b* in a circular tank 25. The coil supports 22, 22*a* and 22*b* each have arcuate inner and outer guide plates extending upwardly from the bottom of the tank 25 for purposes of guiding the coils into a vertically-shaped bundle as they fall from the coiler C. The coil supports 22, 22a and 22b have bottom walls 23 to support the helical coils above the circular bottom wall of the tank.

The tank 25 is indexible and supported for rotation about its center by suitable bearing support 27. The tank is rotated by a motor 26 which, through a suitable drive, drives a pinion gear which in turn meshes with an annular gear 28 located on the outer periphery and under the tank 25. The gear 28 extends throughout the circumference of the tank 25. It should be clear that upon operation of the motor 26 (FIG. 3), the tank 25 is indexed to a position to locate any one of the coil supports 22, 22*a* and 22*b* beneath the coiler C.

The tank 25 is adapted to contain a supply or body of hot water and as the coils drop into the tank of hot water, which is maintained very close to boiling temperature, the coils are in effect cooled, but in a delayed or slow manner, as is known. In effect, a water vapor is formed around each coil as it drops into the tank and this vapor acts as a barrier and effects a delay in the cooling of the rod provides proper metallurgical control of the cooling and desired metallurgical properties for the rod. It should be clear that each coil support 22 is constructed so as to hold one complete coil from one rod. The indexing movement of the tank locates an empty coil support in position under the coiling head. Since the entire tank moves rather than the coil moving in the tank there is a minimum of risk of destroying the vapor barrier formed around the wire rod. This is due to the fact that the complete water bath is indexed as well as the coil. As a result of this, there is no stirring or agitation of the water bath which may be created by movement of the coil within the water bath which could result in uneven cooling of the coil if the vapor barrier were destroyed.

Tank 25 may be supplied with hot water through an inlet 25*a* which extends centrally of the tank and around which the tank indexes. Water may be removed from the tank through an outlet conduit 25b which extends to the bottom of the tank. The conduit 25b is suitably associated with a pump or similar device for removing water from the tank. Conduit 25b is located on the outer periphery of the tank and does not interfere with the rotation of the tank.

Figure 2:
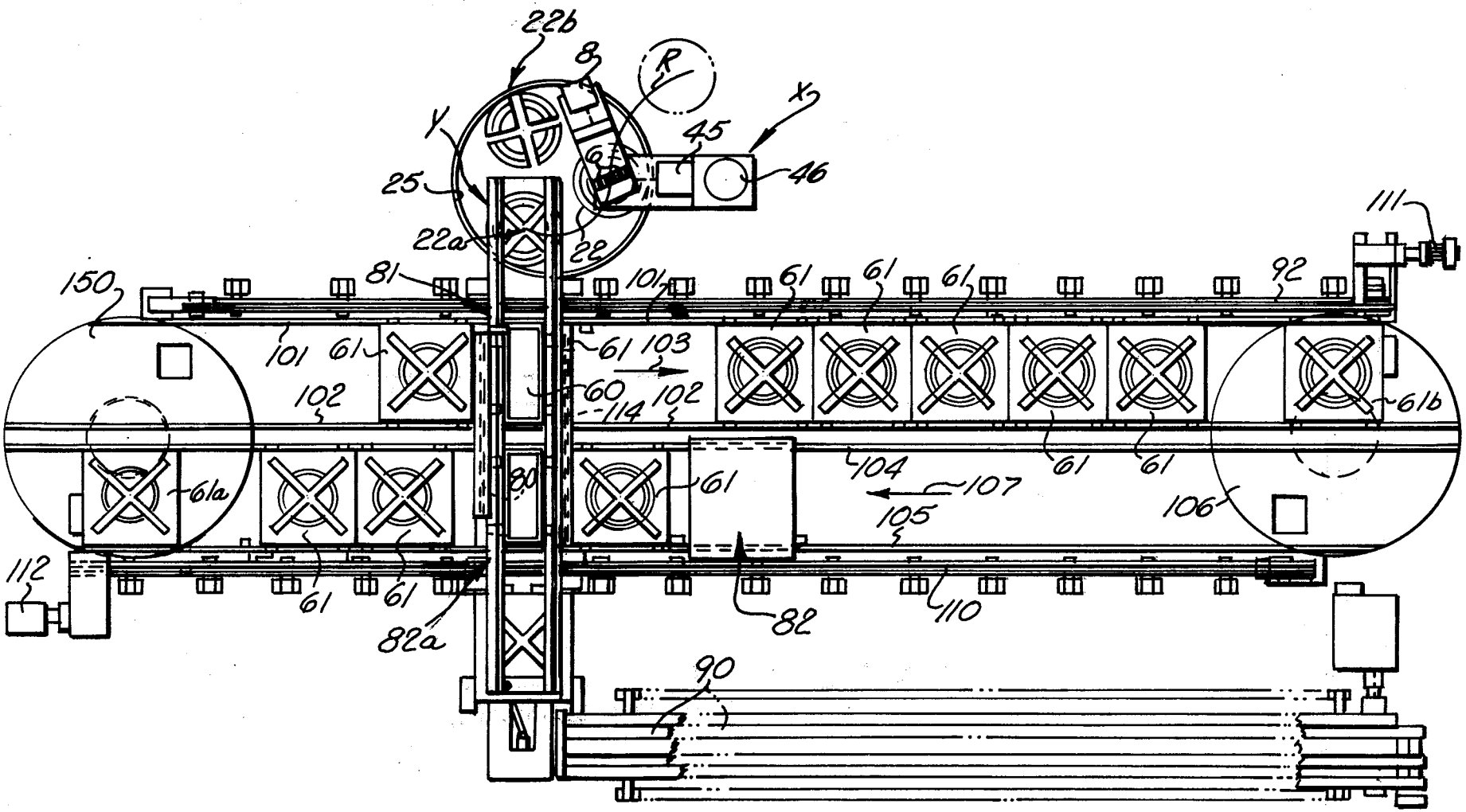
FIG. 2 is also a plan view illustrating the system which receives and handles the rod.

In order to enable rod to be received by the coiler C and coiled while tank 25 is indexing, the coiling head C is constructed to include coil supporting fingers 35, 36. At least three such fingers are provided and preferably four. The fingers 35, 36 are located immediately below the coiling head and are in position to receive coils which may be formed upon rotation of the coiling head. The fingers 35, 36 function to support wire coils which may be received thereby and are positioned in the path of the dropping coils in order to support the coil rod prior to full indexing movement of the cooling bath 25 into position where a coil support 22 is located beneath the coiling head. For example, if the leading edge of a wire rod comes into the coiler C before a full coil or the previously formed coil has been fully indexed from beneath the coiling head, the fingers 35, 36 are located in position (shown in solid lines in FIG. 1) to receive the rod that is coiled. Once an empty coil receiving support 22, 22a and 22b is located beneath the coiling head, the fingers 35, 36 may be moved to a relocated position (shown in dotted lines in FIG. 1) so that the rod or coils that were previously supported thereby are dropped into the cooling bath. Of course, once this occurs, subsequent coils drop directly into the cooling bath. The fingers 35, 36 function to permit a substantially continuous operation of the rolling mill and the coiler even when the cooling bath is being indexed into position. As shown in FIG. 2, the coiler C is operated in a well-known manner by a suitable motor 45 which is supported on a frame 46 which is located above the tank 25. The coiler and frame on which it is mounted, as shown schematically in FIG. 2, can pivot to a position outside of the tank 25.

Further, it should be clear that by providing one coiler with several coil supports 22, 22a and 22b which index beneath the coiling head, the need for switching the hot wire rod between different coilers is avoided. Of course, the problems of such switching of the wire rod is also avoided, which increases the safe rolling speed.

In addition, and as specifically shown in FIG. 3, a suitable detent arrangement, generally designated 47, is provided in order to properly and positively position the tank 25 in the proper location beneath the coiling head. The detent mechanism 47 includes a detent 48 which is positively moved by a suitable reciprocating motor 49 into a receiving opening 50 provided in the periphery of the tank 25. In view of the fact that there are three positions of the cooling tank 25, there are three such openings 50 which positively are engageable with the detent 48 in order to position the respective coil suports 22, 22a and 22b in proper position during operation of the system.

Figure 5:
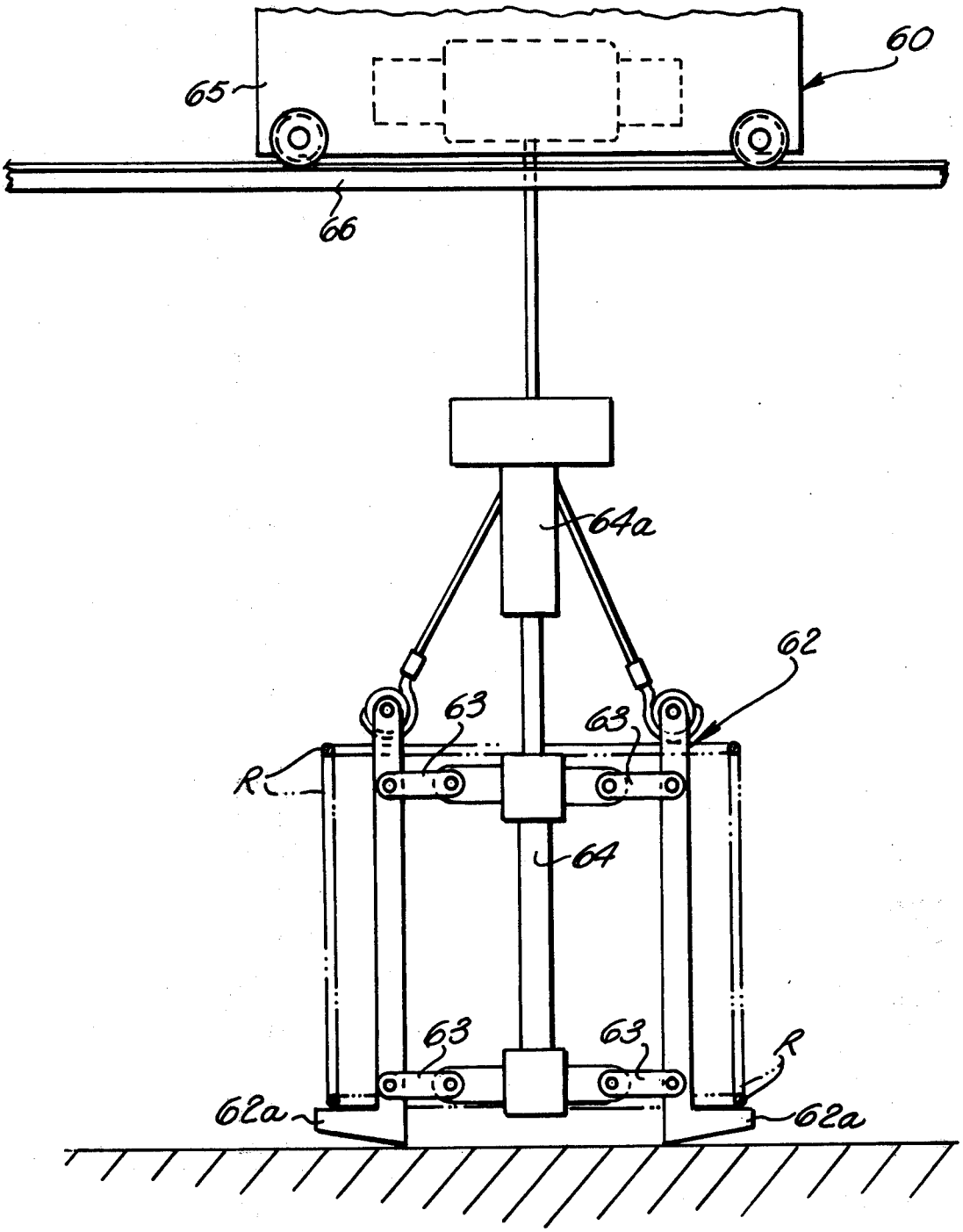
FIG. 5 is a schematic view illustrating a coil handling apparatus used in the system of FIG. 2.

When a completed coil is formed at the coiling station, generally designated X in FIG. 2, the motor 26 (FIG. 3) is energized in order to index the coil as well as the tank 25 into a location, generally indicated Y in FIG. 2. The direction of rotation of the tank could be opposite that shown in FIG. 3; in which event the coil would remain in the tank for a longer time period. A suitable mechanism, generally designated 60 is located at Y and operates in order to remove the coil from the tank 25 and to deposite that coil on a suitable coil-carrying car, designated 61. The mechanism for removing the coil from the bath 25 comprises a suitable stripper mechanism, generally designated 62 (FIG. 5).

The stripper mechanism 62 includes a collapsible-type of lift mechanism which is extensible centrally into the middle of the coil. The mechanism that extends into the middle of the coil in the bath 25 includes four fingers or coil-carrying members 62a. The members 62a are supported by a plurality of links 63 from a central support bar 64. The support bar 64 is moved vertically by a piston and cylinder-type motor 64a. When the support bar 64 moves downwardly it causes the support links or coil support members 62a to move outwardly beneath the coil after the entire mechanism has been dropped into the central portion of the coil. When the support members 62a move outwardly, they enter slots formed between arcuate segments of the guide walls 20 and 21 and are located beneath the coil in the cooling bath 25. Upon vertical movement of the entire mechanism 62, the coil is then removed from the bath 25. The entire mechanism 62 is supported on a suitable carriage, generally designated 65. The carriage 65 is movable on a pair of rails 66, 67.

The rails 66, 67 extend transversely across the path of movement of car 61. After the mechanism 60 has moved along the rails 66, 67 to a position immediately above the car 61, the stripper mechanism 62 is lowered and the motor 64a operates to retract the members 62a and deposit the coil on the car 61. The car 61 then carries the coil for further processing, as will be described hereinbelow. Of course, the mechanism 60 deposits the coil onto the car 61 in exactly the reverse manner in which it received the coil from the cooling bath 25. Each car 61 has a coil support plate or ring, designated 70. Each car also includes intersecting X-shaped slots 71, 72. In order to deposit the coil onto the car, and particularly onto the ring portion 70 thereof, the coil is lowered by the mechanism 62 onto the support ridges 70. The fingers 62a enter the slots 71, 72 as the coil is lowered. Upon upward movement of the rod 64, the fingers and support portions 62a are retracted inwardly of the coil and are thus positioned in order to enable the entire mechanism 62 to be moved within the coil vertically upwardly to clear the upper end of the coil. The coil is then positioned on the car 61 for movement with the car.

The mechanism 60 which picks the coil from the cooling bath 25 and deposits the coil onto a car 61 is moved in a transverse direction along the rails 66, 67 by a piston and cylinder-type motor, designated 80 in FIG. 3. The mechanism 80 merely comprises a pneumatic cylinder which is connected to the frame of the unit and a rod which is connected to carriage 65.

As best shown in FIG. 2, there are a plurality of cars 61 in the system. The cars 61 are progressively moved in a continuous path beneath the coil-receiving station, which is designated 81 in FIG. 2, and to a bundling station 82 (FIG. 2) and then to a coilremoving station which is designated 82a in FIG. 2. At the bundling station 82, there is a mechanism, not shown, which lifts both the car 61 and coil. The coil is automatically wrapped by a device which wraps the coils with straps or wire wrapping and compacts the coil. The car 61 is then redeposited on the tracks and subsequently moved to a coil removal station 82a. A mechanism similar to mechanism 62 is located at 82a. A mechanism similar to mechanism 62 is located at 82a for removing the coils from the cars. From here, the compacted and wraped coils are pushed onto a slot conveyor 90 to be taken to storage or shipping facilities. The coil can be set on the slat conveyor either with the opening of the coil vertically upwardly, normally called "eye-up" or it can be toppled over and sent along the slat conveyor laying on its side. Of course, the car 61 from which a coil is removed at the coil removal station 82 continues to be indexed through its continuous path to receive another coil.

The cars 61 are provided with releasable grippers 90 and are moved along a portion of their continuous path of travel by a continuous conveyor chain 92 which extends parallel to rails 101 and 102. The car-carried grippers 90 selectively grip the conveyor chain 92 in order to move the car along the continuous path of travel. In essence, the cars form a portion of a "power and free" conveyor system which is generally well known.

Each car 61 has a plurality of wheels, namely, four, which move on tracks. As shown in FIG. 2, there are four parallel tracks, designated 101, 102, on which the cars move in the direction of the arrow 103, and tracks 104, 105, on which the cars move in the direction of the arrow 107.

The cars are moved along the tracks by the "power and free" conveyor system which includes the conveyor chain 92 and a plurality of grippers 90 which are selectively actuatable to engage the chain 92 and move the cars along their path of travel. A retractable stop 93 (FIG. 3) is provided adjacent to the pickup or coil-receiving station 81. When the stop 93 is in the extended position of FIG. 3, it is effective to move an extended portion 94 of the gripper 90 upwardly to disengage the gripper from the chain 92. When the car 61 has been loaded with a coil by the coil transfer assembly 60, the stop 93 is retracted and the gripper 90 again engages the continuously driven chain 92 to move the load car forwardly in the direction of the arrow 103.

After a loaded car 61 has moved away from the loading or coil-receiving station 81, the stop 93 is again extended to engage the stop 90 on a next succeeding car 61. When the next car has moved to the loading station, its gripper 90 is actuated by the extended stop 93 and is disengaged from the conveyor chain 92. As a following car is moved to a position adjacent the loading station, a forwardly extending projection 94 on its gripper 90 engages the rear wheel of a car at the loading station and disengages the gripper 90 from the chain 92 to thereby stop the car immediately behind the car at the loading station 81.

Figure 4:
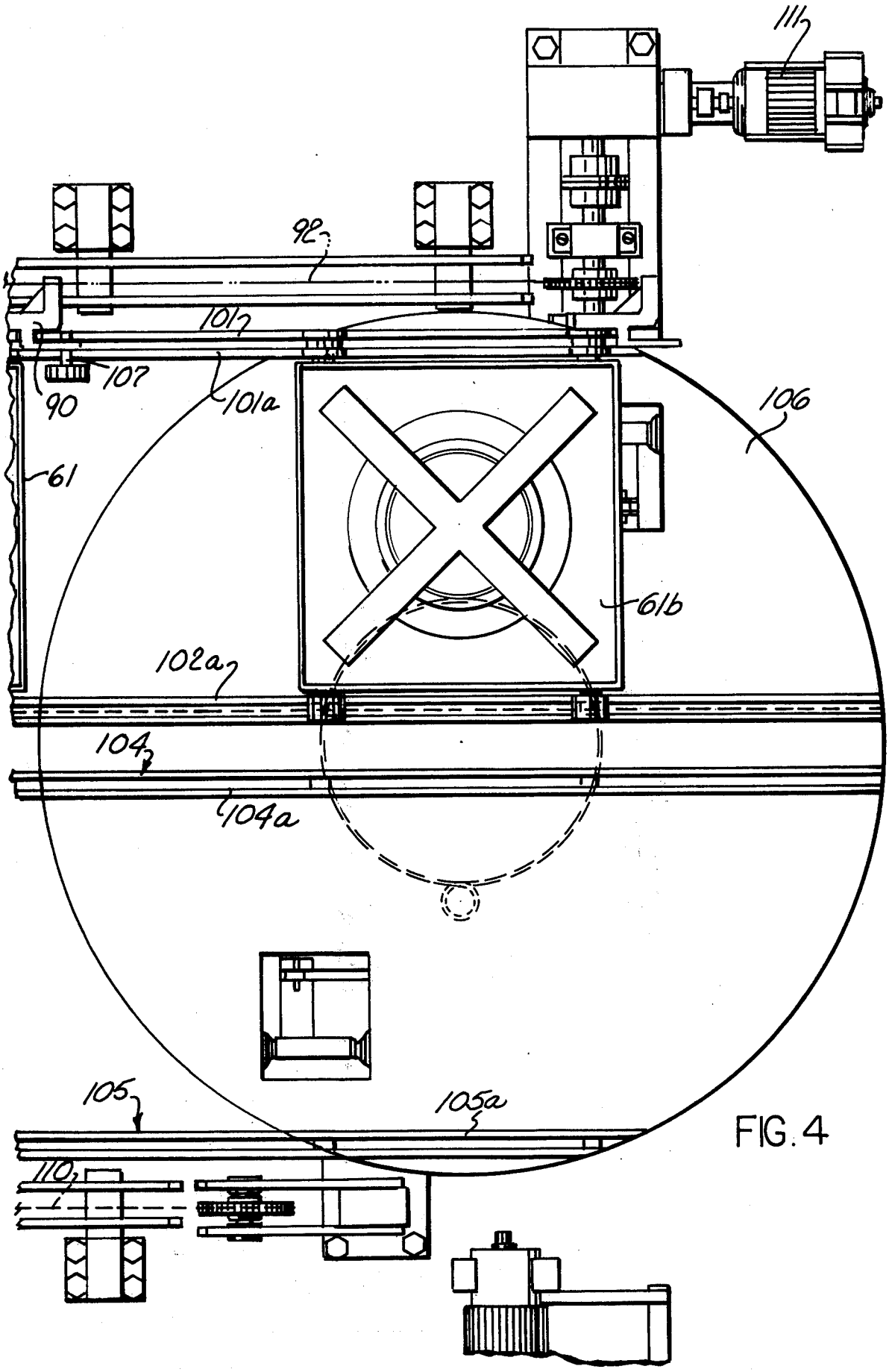
FIG. 4 is an enlarged plan view of another portion of the system of FIG. 2.

In order to provide for indexing movement of the car at the opposite ends of the rails 101, 102, onto the rails 104, 105, a suitable rotatable indexing table 106 is provided. The table 106 comprises turntable having rail portions carried thereon. After each of the cars 61 has been loaded with a coil from the cooling bath 25, the car moves into a lineup of cars waiting on the tracks 101, 102 to be moved onto the tracks 104, 105 by the turntable 106. The gripper 90 of the lead **61*b* in the lineup is disengaged from the conveyor chain 92 by a retractable stop 107 (FIG. 4). The grippers 90 on the succeeding cars in the lineup are disengaged from the conveyor chain 92** by the engagement of their grippers with the rear wheels of the immediately preceding car.

In the event it is desired to move a car, such as car **61*b*, onto the indexible table, the stop 107 is retracted from gripper 90 and gripper 90 on the car 61*b* engages the conveyor chain 92. The conveyor chain 92 moves the car 61*b* onto the rails, designated 101*a*, 102*a* in FIG. 2, which rails are located on the indexible table 106.** As this occurs, a suitable mechanism on the table will lock the wheels of the car on the rails to prevent movement of the car relative to the table.

The table 106, once the car is locked thereon as shown in FIG. 2, is rotated by a suitable indexing drive arrangement. Once indexed, the car **61*b* is located in a position where the rails 102*a*, 101*a* are located in alignment with the fixed rails 104, 105. When that occurs, the car is in a position to be moved from the rails on the indexible turntable 106 onto the rails 104, 105. The lock mechanism for locking the car on the indexible turntable will be disengaged and a second conveyor chain 110 is engaged by the gripper on the car 61*b* to move the car along the rails 104, 105. The continuous conveyor chains 92, 110 are driven at constant speeds by continuously operating motors 111, 112.**

When the car has been moved along the rails 104, 105 toward the station **82*a* if a car 61 is located at the station 82*a* the gripper 90 on the car being conveyed along the rails 104, 105 will engage the rear wheel of that car. This results in disengagement of the gripper 90 from the conveyor 110** to occur with a resulting interruption in forward movement of the trailing car.

When a car is to be moved into the station **82*a* the gripper mechanism 90 will engage the conveyor chain 110. As the car reaches the station, a retractable stop, similar to the stop 93, is extended and the gripper 90 is released from the conveyor chain 110 to stop the car at the station 82*a*. The coil on the car is removed and deposited at the bundling station. The gripper mechanism which removes the coil from the car operates much in the same manner as described above in connection with the gripper mechanism for removing the coil from the coiling bath 25.**

Once the coil is removed from the car, a piston and cylinder type motor 114 operates a carriage on which the coil removal mechanism is located and moves the coil removal mechanism and carriage toward slat conveyor 90. The car from which the coil has been removed is then moved beyond the coil removal station to another turntable, generally designated 150, where the car is then indexed, much in the same manner as described above, so as to be positioned for movement along the rails 101, 102 to a coil-receiving position at station 65, as described hereinabove.

In systems where the cooling process is utilized to control the cooling of the coils, the coils are relatively cold (about 250° F) when they are lifted from the cooling tank 25. The number of coil cars in circulation in such case may be limited to a small number sufficient only to act as a buffer against irregularities in the coiler or the bundling equipment. In cases where controlled cooling is not utilized, for instance, when special alloys are rolled, a large number of coil cars can be utilized and the rails 101, 102, 104, 105 can be extended as necessary to provide the slow cooling of the coils in their travel between the receiving station 81 and the bundling station 82. The number of cars required and the length of the rails required will be evident to those skilled in the art in order to provide the proper heat-treating and cooling time.

It is possible to have one common bundling station and unloading station serve for several coilers. Of course, in such a case one set of coil cars are utilized to transfer the coils from the several coilers and considerable savings in space and expense are provided when several strands are rolled. In addition, it is possible to have the coil removal mechanism which removes coils from the tank traverse a continuous path through the bundling station. Of course, in such a system cars 61 would be eliminated and the coil removal mechanism would perform the function of the cars.

Further, it should be evident from the description above that the installation according to the present invention allows for very high speed rolling. The repeater system allows for perfect synchronization between the laying head and the pinch rolls when the feedback from the photoelectric scanner providing the necessary synchronization. Further, the repeater is capable of bending the rod safely even at high speeds so that no wear will occur on the repeater except for the impact of the initial leading end portion of the wire. The rest of the wire, in effect, floats in the air between the inner and outer guides of the repeater and no scratching of the wire nor wear on the repeater will occur.

Further, it is also evident that the installation which incorporates the present invention will allow for any desired coil weight to be handled. The only limitation is that of the depth of the water tub or bath 25 and the height of the inner and outer guides for supportin the coil in an upright position while it is being coiled and cooled, as well as the corresponding height of the supports on the coil cars. It is also evident that an installation according to the present invention will be able to handle both rods requiring in-line patenting which include controlled cooling in the water bath 25, as well as rods requiring slow annealing where the water bath may not be necessary. It is also evident that the installation, as described, will provide for fully automatic coiling and handling of coils all the way from the finishing stand in the rolling mill into a bundled cold coil ready for shipment or storage in an effective, efficient manner. It should further be clear that the present invention is constructed so that sampling the front and/or tail end of the wire rod which is coiled may be provided. Such sampling can either be manually made while the coils are sitting in the coil cars before they are bundled, or automatic sampling can be accomplished between the finishing stand of the rolling mill and the entry of the rod into the repeater section. Such automatic sampling systems are well known in the art and will not be described herein.

Having described the invention what is claimed is:

1. A rod cooling and coiling system for cooling and coiling rod as it exits from a rod rolling stand, said system comprising a coiler, a guide section for guiding the rod to the coiler, an indexible support having a plurality of coil receiving supports, means for indexing said support to locate said coil receiving supports alternatively beneath said coiler for receiving coiled rod, means for removing a completed coil from one of said coil receiving supports while said coiler is forming coils on another of said coil receiving supports, a plurality of cars which are selectively positionable in a coil receiving location for receiving said completed coils from said coil removing means, means for moving said cars through a car path in which the cars are carried from the coil receiving station to a coil removing station and returned to said coil receiving station, said means for removing a completed coil comprising a first lifting mechanism supported for linear movement along a first path disposed transverse to said car path, a bundling mechanism associated with a portion of said car path disposed up-stream of said coil removal station for bundling a coil prior to its removal from said coil removal station means at said coil removal station for removing a coil from a car comprising a second lifting mechanism supported for linear movement along a second path disposed transverse to said car path said first and second paths being in substantial alignment and extending across said car path.

2. A rod cooling and coiling system as defined in claim 1, further including a plurality of tracks which define said path for said cars, said cars having wheels which move along said tracks, and wherein said path is continuous having first and second adjacent parallel path portions where the cars move in one direction on one path portion and in the opposite direction in the other path portion, and means for moving the cars from one path portion to the other path portion.

3. A rod cooling and coiling system as defined in claim 2 wherein said means for moving said cars from one path portion to the other path portion comprises a rotatable turntable having a horizontal position onto which a car moves from one path portion and which turntable is rotatable to move the car into alignment with the other path portion.

4. A rod cooling and coiling system as defined in claim 2 wherein said means for moving the cars through said continuous path includes a conveyor having a plurality of grippers thereon and wherein said cars have abutments which are engageable with the pushers on said conveyor in order to effect movement of the cars, and means supporting said abutments for movement relative to said cars in order to be located out of the path of movement of said pushers.

5. A rod cooling and coiling system as defined in claim 1 wherein said means at the coil-removal station for removing a coil from a car comprises a hoist mechanism which is insertable into the interior of a coil and which includes coil-supporting members which are movable beneath the coil, and hoist means for lifting said supporting members and the coil from the car.

6. A rod cooling and coiling system as defined in claim 1 wherein said cars move through a continuous path having two parallel horizontal path portions and connecting horizontal path portions at the terminal ends of the two parallel path portions.

7. A rod cooling and coiling system as defined in claim 1 wherein said plurality of coil-receiving supports are located in a tank for containing said liquid bath into which the coils drop as they are formed by said coiler, and said means for indexing said indexible support comprises means for indexing said complete liquid bath as well as any coil located therein.

8. A rod cooling and coiling system as defined in claim 7 further including detent means for locating and holding said indexible support in position.

9. A rod cooling and coiling system for cooling and coiling rod as it exits from a rod rolling stand, said system comprising a coiler for forming the rod into a plurality of coils, guide means for guiding the rod from the rolling mill into said coiler, a container located beneath said coiler, a supply of liquid disposed in said container and forming a liquid bath, means for supporting said container for rotation relative to said coiler, a plurality of coil support means supported in said liquid bath in said container and disposed to be individually brought into alignment with said coiler as said container is rotated relative to said coiler, means for indexing said container and said coil support means beneath said coiler to move a coil support means which has received a coil from said coiler out of alignment with said coiler and to bring another coil support means into alignment with said coiler, said means for indexing said container being operative to index said container at a speed whereby said liquid bath is maintained in a state in which it forms a vapor barrier around the coils being received by a coil support means and maintains the vapor barrier during movement of the container relative to said coiler.

10. A rod cooling and coiling system as defined in claim 9 further including lift means for lifting a coil from said bath, means supporting said lift means for movement over said bath and for movement to a coil-depositing station.

11. A rod cooling and coiling system as defined in claim 10 further including a plurality of cars, means guiding said cars for movement in a continuous path beneath said lift means at said depositing station to receive a coil therefrom.

12. A rod cooling and coiling system as defined in claim 11 wherein said continuous path has two parallel coextensive adjacent path portions and means at the ends thereof for transferring cars therebetween.

13. A rod cooling and coiling system as defined in claim 12 wherein said means for transferring cars between said path portions comprises a turntable onto which said cars move from one path portion and which are rotatable 180° to align the car thereon with the other path portion, and means for moving the cars along said path portions.

14. A rod cooling and coiling system as defined in claim 9 wherein said coiler comprises selectively actuatable means for receiving and supporting a coiled portion of the rod in a position out of engagement with said liquid bath before the coiled portion is received by a coil receiving support.

15. A rod cooling and coiling system for cooling and coiling rod as it exits from a rod rolling stand, said system comprising a coiler for forming the rod into a plurality of coils, guide means for guiding the rod from the rolling mill into said coiler, means providing a container having a supply of liquid forming a liquid bath, said container being located beneath said coiler so that coils which are dropped from said coiler are received by said liquid bath; means for indexing said container beneath said coiler to bring a portion of said liquid bath into alignment with said coiler and to move a portion of said liquid bath which has received a coil out of alignment with said coiler, said means for indexing said container being operative to index said container at a speed at which a vapor barrier is formed about the coils being received by said liquid bath and is maintained as the coil is moved out of alignment with said coiler, a coil removing hoist mechanism moveable over said container and including means moveable into the bath centrally of a completed coil and engageable with the lower portion of the coil in order to support the coil and lift the coil from the bath, means for moving said coil and said hoist from its position over the bath into a position adjacent the bath at a coil transfer location, a plurality of cars for receiving a coil from said hoist at said transfer location, said cars being moveable in a continuous path through said coil transfer location and being positionable there at for receiving a coil from said hoist, said means for moving said coil and said hoist including means for moving said coil and said hoist along a path transverse to the path of movement of said cars through said coil transfer location.

* * * * *